United States Patent [19]

Theurer

[11] 4,046,079

[45] Sept. 6, 1977

[54] TRACK SURFACING APPARATUS

[75] Inventor: Josef Theurer, Vienna, Austria

[73] Assignee: Franz Plasser Bahnbaumaschinen-Industriegesellschaft m.b.H., Vienna, Austria

[21] Appl. No.: 644,638

[22] Filed: Dec. 29, 1975

[30] Foreign Application Priority Data

Jan. 31, 1975 Austria ..... 738/75

[51] Int. Cl.[2] ..... E01B 27/17

[52] U.S. Cl. ..... 104/7 R; 104/8; 104/12

[58] Field of Search ..... 104/2, 7 R, 7 B, 8, 104/12

[56] References Cited

U.S. PATENT DOCUMENTS

| | | | |
|---|---|---|---|
| 3,486.461 | 12/1969 | Plasser et al. | 104/7 R X |
| 3,557,459 | 1/1971 | Plasser et al. | 104/8 X |
| 3,871,299 | 3/1975 | Plasser et al. | 104/7 B |
| 3,926,123 | 12/1975 | Plasser et al. | 104/7 R |
| 3,968,752 | 7/1976 | Theurer | 104/7 B |

*Primary Examiner*—Robert J. Spar
*Assistant Examiner*—Randolph A. Reese
*Attorney, Agent, or Firm*—Kurt Kelman

[57] ABSTRACT

A mobile apparatus for dynamically stabilizing a ballast bed supporting a track at a desired level comprises a reference for determining a deviation of the track grade from the desired level, a chassis running on the track rails on flanged wheels, vibrators for imparting at least approximately horizontal vibrations to the track engaged by the flanged wheels, a mechanism for laterally pressing the flanged wheels into play-free engagement with their associated rails, the flanged wheels and the vibrators being arranged on the chassis to vibrate in unison to transmit the vibration to the track, the loads associated with each rail and supplemental to the weight of the apparatus for imparting a pressure to the rails in the direction of the ballast bed whereby the vibrating track is pressed to a lower level.

22 Claims, 6 Drawing Figures

TRACK SURFACING APPARATUS

Figures 1, 4, 5, 6:
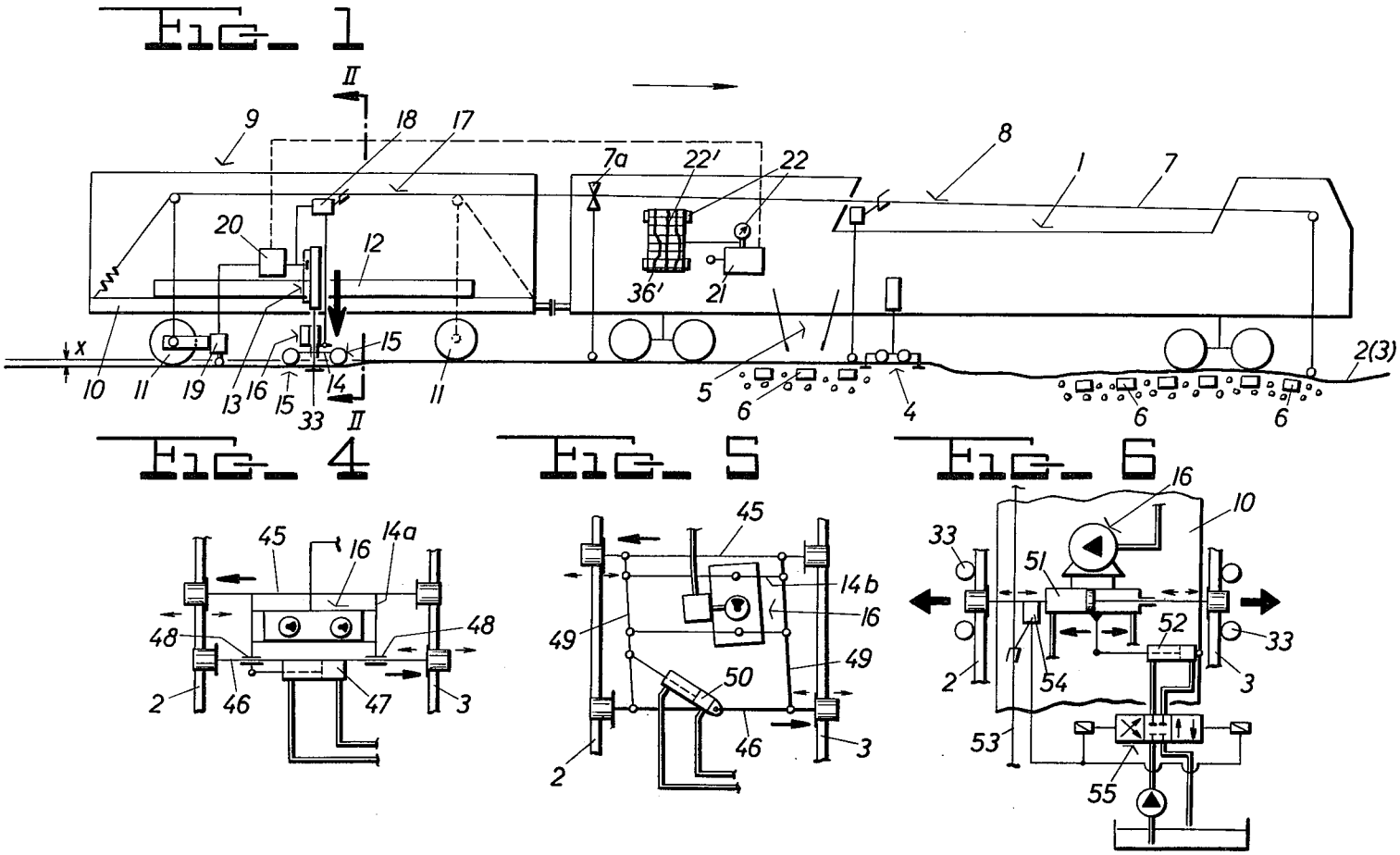

The present invention relates to improvements in a mobile apparatus for compacting ballast of a ballast bed supporting a track consisting of two rails fastened to ties resting on the ballast.

Apparatus of this type is known from U.S. Pat. No. 3,926,123, dated Dec. 16, 1975, which comprises means for determining a deviation of the track position from a desired level, a chassis having a running gear including rail engaging and guiding means associated with each of the rails and mounting the chassis for mobility on the track, means for imparting at least approximately horizontal vibrations to a section of the track engaged by the rail engaging and guiding means, the vibration imparting means including a vibration producing means arranged on the chassis, and load means supplemental to the weight of the apparatus in the region of the vibration imparting means for imparting a pressure to both rails of the track in the direction of the ballast bed whereby the track is pressed to a lower level which preferably is the desired level of the track.

Tamping ballast, particularly under the track ties, has the primary purpose of preventing settling of the track immediately after the track surfacing work has been completed. At such time, the track usually settles unevenly and in this manner undoes the previously effected track position correction. The traffic loads to which the newly repositioned track is subjected produce pressures and vibrations which cause the rearrangement of the ballast pieces until the same have been wedged together sufficiently to stabilize the ballast bed. If this stabilization of the ballast bed, which involves a lowering of the track, is controlled by a suitable reference system the track level may be stabilized in a highly accurate manner.

Such dynamic stabilization has been proposed in the above-identified patent disclosing an apparatus suitable for this purpose and in U.S. Pat. No. 3,919,943, dated Nov. 18, 1975, which discloses a concomitant method. The ballast stabilization is obtained by substantially horizontally vibrating the track while depressing it. The vibratory and pressure forces are transmitted to the track by double-beveled wheels engaging the rail heads and being adjustable transversely of the track. Such double-beveled wheels transmit the forces to the track substantially only at a point where the beveled wheel surface contacts the rail. Due to the considerable forces involved, this may cause damage to the track rails and/or the wheels. Furthermore, the prior arrangement makes no provisions for pressing the wheels without play against the associated rails as the track gage changes. Therefore, particularly in track sections with changing track gages, it is not possible to transmit the vibrations properly to the track, i.e. to maintain the desired amplitude and/or frequency of the vibrations, during the entire operation, and this reduces the effectiveness of the ballast stabilization.

It is the primary object of this invention to improve the transmission of the vibratory and pressure forces to the track in a dynamic track stabilization of the indicated type.

The above and other objects are accomplished in accordance with the broadest aspect of this invention by associating means with the rail engaging and guiding means for simultaneously laterally pressing the rail engaging and guiding means associated with each rail without play against the rail with which it is associated.

The rail engaging and guiding means and the vibration producing means are arranged on the chassis to vibrate in unison whereby the rail engaging and guiding means transmit the vibration to the track section. According to a preferred embodiment, the pressing means comprises a mechanism for spreading cooperating ones of rail engaging and guiding elements associated with each rail to press them against the inside of the associated rail and a locking mechanism for locking such elements in a position pressing them against the outside of the rails.

The play-free engagement of the rail engaging and guiding elements with both rails assures a shock-free transmission of the vibratory and pressure forces to the track rails even while the apparatus continuously advances along the track during the stabilization operation.

Furthermore, this arrangement assures the transmission of the amplitude and frequency of vibrations produced by the vibrators almost without loss from the chassis to the rail engaging and guiding elements, the two track rails firmly gripped thereby, the entire track and deep into the ballast on which it rests. When the nature of the vibrations is changed, the changed vibrations produced by the vibrators are equally transmitted without distortion. In addition and unexpectedly, the play-free transmission of the vibratory and pressure forces reduces the wear on the rails and the rail fasteners because all vibrating parts — vibrators to track — are, in effect, fixedly interconnected and substantially no resonance forces will affect any of them. It has accordingly been found that an apparatus incorporating the improvement of the present invention will accurately reposition and stabilize in the leveled position even tracks which rest on relatively strongly encrusted and hard ballast beds. In other words, the apparatus may be effectively used on operational track without prior surfacing work because relatively large vibratory and pressure forces may be transmitted to the track without exposing the rail fastening elements to undue stress and possible breakage.

Figure 2:
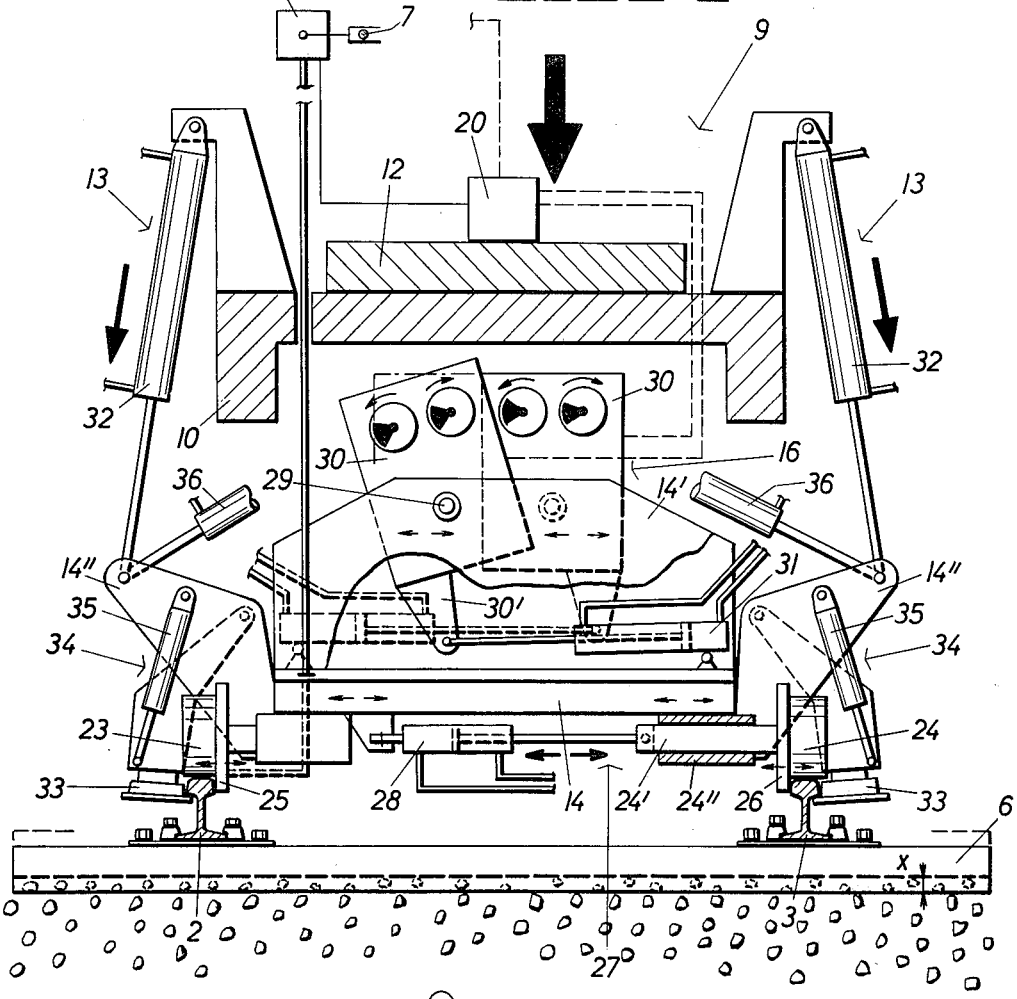

The above and other objects, advantages and features of the present invention will become more apparent from the following detailed description of certain now preferred embodiments thereof, taken in conjunction with the accompanying drawing wherein FIG. 1 is a schematic side elevational view of a track leveling and lining tamper combined with, and in the operating direction preceding, a mobile ballast compacting apparatus according to this invention;

FIG. 2 is a section along line II—II of FIG. 1; and

FIGS. 3 to 6 schematically show, in a front elevational view and in top views, respectively, different embodiments of means for laterally pressing the rail engaging and guiding elements of the apparatus without play against the rail with which they are associated.

Referring now to the drawing and first to FIG. 1, there is shown a conventional mobile track tamper 1 designed for leveling and lining a track consisting of two rails 2, 3 fastened to ties 6 resting on ballast. As is well known and need not be described in detail herein, this machine comprises a combined track lifting and lining unit 4 and a tamping unit 5 for tamping ballast under ties 6 to fix the track in the leveled position obtained by unit 4 in cooperation with reference wire 7 of reference system 8.

Car 9 is coupled to tamper 1 and carries the apparatus of the invention. This arrangement has the advantage that the dynamic track stabilization is effectuated immediately after the track position has been corrected and before the repositioned track is subjected to train traffic. Such an arrangement is very economical because of the operator of the tamper can also control the succeeding ballast compaction and track stabilization, thus producing high accuracy in the track position. However, it will be understood that car 9 may be used independently.

The car comprises frame 10 mounted on two undercarriages 11, 11 for mobility on the track. If desired the frame may carry a cabin for an operator or housing for operating personnel. The weight of the car may advantageously be increased by mounting thereon weights 12 which may consist, for example, of concrete or iron plates, or water or oil tanks. As is best shown in FIG. 1, chassis 14 is arranged centrally between undercarriages 11, 11 and, as illustrated in FIG. 2, hydraulic drives 13, 13 are associated with each of rails 2, 3 and connect the chassis to car frame 10, cylinder 32 of the hydraulic drives being pivoted to the car frame and the piston rod thereof being pivoted to the chassis. The hydraulic drives operate as load means supplemental to the weight of car 10 for imparting a pressure to both rails of the track in the direction of the ballast bed whereby the track is pressed to a lower level.

Running gears 15 mount chassis 14 for mobility on the track and the chassis carries vibrators 16 for producing at least approximately horizontal vibrations.

Reference system 17 extends between undercarriages 11, 11 of car 9 for controlling the pressing of the track to a lower, desired level by means of hydraulic drives 13, 13. In the illustrated embodiment, this reference system is constituted by an extension of reference wire 7, systems 8 and 17 being separated from each other by wire clamping device *7a* which clamps the wire in the region between tamper 1 and car 9. In a manner well known in track surfacing, the reference wire cooperates with a track survey element 18, which may be any transducer, such as a potentiometer, a transformer or the like, mounted on a rod in fixed relationship to chassis 14. As indicated in broken lines, reference system 17 need not be integral with reference wire 7 but could be a separate reference wire extending between two guide rollers supported on the respective undercarriages and having its ends anchored to car frame 10.

Rail sensing element 19 is associated with the rear undercarriage 11 of car 9 to measure the distance between the axle bearing of the undercarriage and the upper edge of rail 2 or 3. A control circuit connects sensing element 19, measuring element 18 and a solenoid valve in the hydraulic fluid supply line to drives 13 to control 20 for controlling operation of the drives in response to means 18, 19 for determining a deviation of the track position from a desired level whereby the track is pressed to a lower level until the desired level has been reached. Control 20 is connected by a control circuit to control panel 21 and track level indicating and recording instrument 22 arranged in the operating cabin of track tamper 1.

FIG. 2 shows chassis 14 with vibrators 16 and load-transmitting hydraulic drives 13, 13 on an enlarged scale. The chassis is mounted for mobility on track rails 2, 3 on a running gear consisting of rail engaging and guiding elements constituted by flanged wheels 23 and 24 whose vertical flange parts 25 and 26, respectively engage the inside of rails 2 and 3. Mechanism 27 spreads the cooperating flanged wheels associated with each rail to press the flanged part 25, 26 of the spread wheel against the associated rail without play. In the illustrated embodiments, the spreading mechanism comprises a pressure-fluid operated, preferably hydraulic, drive.

In the embodiment of FIG. 2, flanged wheel 24 is laterally movable in relation to the chassis, stub shaft 24' of the wheel being slidably journaled in bearing sleeve 24'' affixed to chassis 14, while flanged wheel 25 is laterally fixed in relation to the chassis. The cylinder of hydraulic motor 28 is fixedly mounted on the chassis and its piston rod is linked to stub shaft 24' to enable the same to be reciprocated transversely of the track. Supply of hydraulic fluid to motor 28 will move wheel 24 into play-free engagement with rail 3 whereby the other wheel 25 is pressed into play-free engagement with rail 2. Such a drive connected only to the rail engaging and guiding element associated with one rail is structurally very simple and reduces the number of vibration transmitting members between vibrator and track.

While a hydraulic motor may be preferred, pneumatic drives may also be used effectively, as may be electric motors, and any such motors may operate threaded spindle-and-nut drives, rack-and-pinion drives and the like for laterally moving the rail engaging and guiding elements into play-free engagement with their associated rails, any such spreading mechanisms serving to transmit the vibratory forces effectively since they do not damp the vibrations or reduce the vibratory forces, in contrast, for instance, to a spring transmission arrangement. Furthermore, these mechanisms have the added advantage of permitting remote control.

Vibration producing means 16 consists of two vibrators 30, 30 mounted on carrier portion 14' of chassis 14 for pivotal adjustment about pivots 29, 29 extending in the direction of the track for changing the direction of the vibrations produced thereby from vertical to horizontal. Lugs 30' extend from the lower ends of the vibrators and are linked to hydraulic motors 31 mounted on the chassis for pivoting the vibrators into desired positions. As schematically shown, the vibrators have eccentric masses which are rotated to produce the desired rotations, the vibrators being preferably arranged to swing in phase.

The adjustability of the vibrators makes it possible to adapt the horizontal component of the vibrations and the vibratory force imparted to the track to differences in the rail fastening elements used in the particular track, thus avoiding undue stresses and possible breakage of these elements, which would lead to the destruction of the track. Furthermore, this adjustability also makes it possible to change the magnitude of the downward pressure on the track and/or the operating time at different track sections since, for instance, the vibrators may be adjusted during the end stroke of the downward track movement to impart vertical vibrations to the track and thus to aid in overcoming the very strong resistance of the ballast bed against further downward movement of the track at this point of operation.

Chassis 14 has a pair of brackets 14'', 14'' extending transversely of the track and projecting beyond rails 2, 3 and the chassis is carried on car frame 10 by hydraulic drives 13, 13 whose cylinders 32 are linked to frame 10 and whose piston rods are linked to brackets 14'', 14''. Operation of these drives will exert a downward load on chassis 14 and rails 2, 3 gripped by the running gear of the chassis.

In the embodiment of FIGS. 1 and 2, cooperating pairs of rail engaging and guiding elements are associated with each rail, one element of the cooperating pairs being flanged wheel 23, 24, having vertically extending flange 25, 26 engaging the inside of associated rail 2, 3 and the other element of the cooperating pairs being flanged wheel 33 having a substantially horizontally extending flange subtending the rail head and engaging the outside of the associated rail. As shown in FIG. 2, flanged wheels 33 are mounted on brackets 14″, 14″ for pivoting movement in a plane transverse to the track about a pivot extending in the direction of the track and locking mechanism 34 enables the wheels 33 to be engaged without play with the associated rails, the illustrated locking mechanism being constituted by hydraulic motors 35. As shown in FIG. 1, a pair of flanged wheels 23, 24 is associated with each rail 2, 3, the wheels being spaced apart in the direction of the track and the flanged wheels 33 being arranged centrally between the wheels 23, 24, in association with each rail.

The above-described apparatus operates in the following manner:

The irregularly positioned track is raised and lined by unit 4 to assume a desired position and is then fixed in position by tamping ballast under ties 6 by tamping unit 5. In this track correction operation, the ballast pieces are repositioned in relation to each other so that subsequent loads on the freshly tamped ballast cause the ballast to be further compacted and the track resting thereon to settle. Depending on the amplitude and/or frequency of the vibrations imparted to the track by trains running thereover and the differences in the lining and/or leveling parameters at various points along a long track section, the track settles to varying extents during the initial phase of traffic after track correction, the track settling much more rapidly during this initial phase than after the train traffic has had a chance fully to compact the ballast again. This causes errors in the track position to appear relatively shortly after the track leveling and/or lining operation has been completed and thus reduces the quality of the track.

To reduce or avoid the occurrence of these errors, the apparatus of the present invention is used to stabilize the track in its corrected position. This is done by operating the vibrators 30 in phase and simultaneously depressing the track by operation of hydraulic motors 13. In this manner, the otherwise haphazard compaction of the ballast by the train traffic is effected in a controlled manner, the vibrations of, and load on, the track simulating traffic conditions but being effected under the control of reference system 17, 18 which surveys the lowering stroke $x$ of chassis 14 and indicates the same on instrument 22 and records it on graph 22′. Thus, the controlled vibration and lowering of the corrected track anticipates, at least a major portion of the compaction of the ballast by the normal train traffic so that the subsequent traffic can cause only minor further depressions or dislocations, if any at all.

The play-free engagement of the flanged wheels with the track rails makes it possible for the wheels to transmit the vibrations to the track properly and in a manner which avoids subjecting the rail fastening elements to undue stresses which may lead to their breakage and the destructions of the track, the forces involves being quite considerable. Such engagement without play is reinforced by using pairs of cooperating wheels which engage the inside and the outside of each rail, as shown in FIG. 2. In this manner, the vibrations produced by vibrators 30 are transmitted from chassis 14, on which the vibrators are mounted, to flanged wheels 23 which are fixedly mounted on the chassis, as well as to pressure fluid drive 28 and to flanged wheels 24 connected thereto, and to pressure fluid drives 35 and flanged wheels 33 connected thereto, the flanged wheels firmly gripping track rails 2, 3 so that the whole assembly vibrates in unison, with the flanged wheels transmitting the vibrations to the track. The vibratory forces are equally distributed over both rails and only half of these forces is transmitted to the track by each rail. This not only provides less stress on the rail fastening elements but also avoids shock forces. At the same time, the hydraulic drives 13 press on brackets 14″ which are fixedly connected to chassis 14, flanged wheels 23, 24 and transmitting the downward pressure to each rail and, via track ties 6 which are fastened to the rails, to the underlying ballast. The vertical loads and the substantially horizontal vibrations extending more or less parallel to the track plane and transversely to the track simululate traffic conditions in a track section extending over several ties and for a distance equal at least to the spacing between undercarriages 11 of car 9, causing track ties 6 to be "rubbed into" the ballast. This effect may be enhanced by adjusting the direction of the vibrations while the track is lowered by stroke $x$, which is done by operating hydraulic motors 31 to pivot vibrators 30 about pivots 29. In this manner, the horizontal vibrations may, during the operation, be partially or fully replaced by oblique or vertical vibrations.

Control 20 may be used to survey the track lowering stroke $x$ and to control the downward pressure exerted by hydraulic motors 13. For instance, the pressure may be increased in response to control signals emitted from track level measuring device 18 just before the full stroke $x$ has been reached and may then be reduced or discontinued when this stroke has been completed. Furthermore, these signals may also control operation of motors 31 so that, at a given point in stroke $x$, the horizontal vibrations are partially and possibly finally fully replaced by vertical vibrations. This vibration direction control may be used in dependence on the type of rail fastening elements of the specific track. For instance, if rail spikes or specially formed spring spikes are used to fasten the rails to the ties, an oblique vibration component may be applied to the track to avoid pulling these spikes out of the ties.

As shown in FIG. 1, control 20 is also connected to sensing element 19 so as to avoid lifting car 9 with its undercarriages 11 off the track under excessive downward pressure exerted by hydraulic drives 13. The sensing element operates as a kind of limit switch and, as soon as it is actuated, it immediately causes hydraulic fluid flow to cylinders 32 to cease, thus discontinuing the downward pressure on chassis 14 and the track. Furthermore, the vertical loads may be adapted to various types of tracks, such as main tracks and branch tracks, by the arrangement of suitable weights 12 on car 9.

When several vibrators are used, the effectiveness of the vibration producing means will be increased and all the produced vibrations will be fully utilized if all the vibrators swing in phase.

To avoid lateral dislocation of the track while it is pressed down, hydraulic lining drives 36 may be mounted between car frame 10 and brackets 14″, as shown in FIG. 2. With the use of a conventional lining reference system whose chord, as is known, is guided in fixed spatial relationship to the grade rail, the lateral position of the track in the region of car 9 may be indicated at instrument 22 and may be recorded on graph 36' of recording instrument 22. If lining errors are indicated and recorded, they may be eliminated by operation of lining drives 36. Any stresses which are freed during the vibrations and lowering of the track and lead to lining errors may in this manner be avoided or immediately corrected.

The apparatus of this invention may also be used to advantage when no leveling is desired or required during a lining operation. By imparting vibrations to the track and ballast, the required lining forces may be reduced and any stresses in the track may be eliminated to facilitate the lining movement. In this case, the vertical loads may be eliminated or, if any vertical pressure is desired, a controlled vertical vibration component may be applied to the track, as may be desirable in dependence on the lining force.

While the above description of the operation of the apparatus has referred to the embodiment of FIGS. 1 and 2, it also applies to the embodiments of FIGS. 3 to 6 to be described hereinafter.

Figure 3:
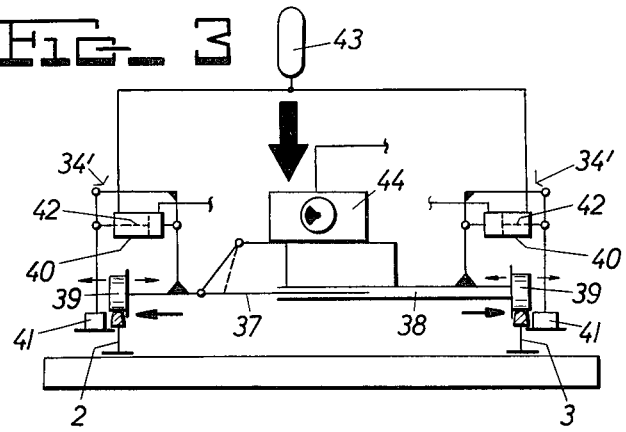

In the embodiment of the apparatus chassis shown in FIG. 3, the chassis is comprised of two telescoping parts 37, 38, each chassis part carrying flanged wheel 39 whose vertical flange is arranged to engage the inside of track rails 2, 3. As in the embodiment of FIG. 2, the flanged wheels 39 cooperate with flanged wheels 41 whose horizontal flange subtends the rail heads and engages the outside of the track rails. A locking mechanism 34' is associated with each chassis part and comprises hydraulic drive 40. Each hydraulic drive is connected to a linkage which, on the one hand, connects the cylinder of the drive to an element fixedly mounted on a respective one of the chassis parts, and on the other hand, connects the piston rod of the drive to a pivotal element carrying flanged wheel 41. Supply of hydraulic fluid from storage tank 43 to cylinder chambers 42 will spread wheels 39 and lock wheels 41 into play-free engagement with the track rails. The hydraulic pressure in drives 40 is preferably so controlled that the blocking power exerted upon wheels 39 and 41 is at least half that of the vibratory power produced by vibrator 44. The two other cylinder chambers of drives 40 may be connected to a hydraulic fluid pump or other hydraulic pressure source to enable flanged wheels 41 to be pivoted out of engagement with the track rails upon opening a valve interposed between the hydraulic pressure source and the other cylinder chambers. This embodiment effectively combines the spreading and locking mechanism into a single drive.

Other useful embodiments of means for laterally pressing the rail engaging and guiding means associated with each rail without play against the associated rail will readily occur to those skilled in the art. For instance, minor structural modifications may suffice to provide such means in chassis with rigid sets of wheels.

For instance, in the embodiments of FIGS. 4 and 5, two sets of wheels 45, 46 form the running gear of the chassis, the flanged wheels of each set being interconnected by a rigid axle whereby the spacing between the wheels remains constant and the axles being movable laterally in relation to each other transversely of the track. In the embodiment of FIG. 4, chassis 14*a* is rigidly connected to wheel set 45, the chassis carrying the vibration producing means. Wheel set 46 is mounted in transverse guide 48 for lateral movement in relation to the chassis and hydraulic drive 47 rams wheel set 46 against rail 3 to engage one of its flanged wheels without play with this rail while forcing the opposite flanged wheel of wheel set 45 without play against rail 2. The vibrations from the vibrators on chassis 14 to the rails is transmitted through drive 47. The arrangement is very simple.

Also quite simple is the structure of FIG. 5 wherein the wheel sets 45 and 46 are pivotally connected by linkage 49 which permits lateral movement of the wheel set axles in relation to each other, chassis 14*b* also taking the form of a frame whose parts are linked together for pivotal movement and carrying the vibrators. Hydraulic drive 50 is mounted between two links of linkage 49 to press the two wheel sets in opposite directions into play-free engagement with a respective one of the rails.

These two embodiments are particularly useful when the apparatus by intermittently advancing from one compaction point to the next so that the lateral pressure on the rails is applied only at the compaction points.

In the illustrated embodiments, the means for laterally pressing the rail engaging and guiding elements without play against the associated rails operate with hydraulic pressure and the vibration producing means generates a vibratory force of about twice the power of the lateral pressure. This vibration producing means may comprise rotary eccentric masses rotated by an electric motor, as in FIG. 4, or a hydraulic motor, as in FIG. 5, or it may comprise vibrators operated by hydraulic frequency generators, as in FIG. 6. If the rail engaging and guiding means are constantly pressed against the rails by continuously supplying hydraulic fluid to the drives, the vibrations will be steadily transmitted to the track even at peak power, thus avoiding shocks and damage to the rail fastening elements.

In the embodiment of FIG. 6, the axle of the running gear consists of two telescoping axle parts, one axle part carrying the cylinder of drive 51 while the other part carries or forms the other axle part. This drive serves to spread wheels of the running gear into engagement with their associated rails without play. The vibrations from vibration producing means 16 are transmitted from drive 51 to the flanged wheels and the track rails engaged thereby. Double-acting hydraulic drive 52 is connected to drive 51 to enable the same to be laterally moved in a desired direction to line the track. Lining drive 52 is mounted on frame 10 of the apparatus. A lining reference system comprising reference line 53 cooperates with alignment measuring device 54 to emit suitable control signals for the lining operation. Any deviation of the lateral track position from a desired position is detected by device 54 which cooperates with reference line 53 and the resultant control signal operates solenoid slide valve 55 to supply hydraulic fluid into a respective cylinder chamber of drive 52 to force drive 51 into one or the other direction determined by the control signal and thus to move the engaged track laterally into the selected direction until the track has been lined. The lining movement is greatly facilitated by the vibratory force to which the track and ballast are subjected during the lining.

As shown, the running gear is mounted intermediate pairs of flanged wheels 33 which engage the outside of the rails in the manner shown in FIG. 2, thus providing a more secure grip in the track rails during the lining movement and improving the transmission of the vibrations to the track. If simultaneous leveling is desired, this embodiment may also be provided with hydraulic drives 13.

The downward pressure on the track may consist of the load of the chassis itself, in which case the chassis may be of very heavy construction, or the chassis itself may be light and a hydraulic drive or like pressure means may be combined therewith to provide the desired load, or the vibratory power may be at least partially used for this purpose. These variations make it possible to change the pressure forces within relatively wide limits. Obviously, all types of vibration producing means, including remote-controlled vibrators, may be used. Finally, while hydraulic drives have been described and illustrated, mechanical drives, such as spindle-and-nut drives, tackles and similar drives may be substituted.

I claim:

1. In a mobile apparatus for compacting ballast of a ballast bed supporting a track consisting of two rails fastened to ties resting on the ballast, which comprises means for determining a deviation of the track position from a desired level, a chassis having a pair of rail engaging and guiding means spaced in the direction of track elongation and associated with each of the rails and mounting the chassis for mobility on the track, means for imparting at least approximately horizontal vibrations to a section of the track engaged by the rail engaging and guiding means, the vibration imparting means being a vibration producing means arranged on the chassis, and load means in the region of, and associated with, the vibration imparting means for imparting a pressure to both rails of the track in the direction of the ballast bed whereby the track is pressed to a lower level while being vibrated, the improvement of the vibration imparting and load means being associated with the rail engaging and guiding means for simultaneously laterally vibrating and vertically loading each of the rail engaging and guiding means, and further comprising means for pressing the rail engaging and guiding means associated with each rail without play with respect to the chassis and against the rail with which it is associated, the load and the vibration producing means being arranged on the chassis to load and vibrate the rail engaging and guiding means in unison whereby the rail engaging and guiding means transmit the vibration and load to the track section.

2. In the mobile apparatus of claim 1, the load means being connected with the vibration-producing means.

3. In the mobile apparatus of claim 1, control means operating the load means in response to the means for determining a deviation of the track position from a desired level whereby the track is pressed to a lower level until the desired level has been reached.

4. In the mobile apparatus of claim 1, the vibration producing means comprising vibrators mounted for pivotal adjustment about an axis extending substantially in the direction of the track for changing the direction of the vibrations from vertical to horizontal.

5. In the mobile apparatus of claim 4, the vibrators being arranged to swing in phase.

6. In the mobile apparatus of claim 1, the rail engaging and guiding means including at least one element associated with each rail and having a part engaging the inside of the associated rail, and the means for laterally pressing the rail engaging and guiding means comprising a mechanism for spreading cooperating ones of the elements associated with each rail to press the part of the spread element against the associated rail.

7. In the mobile apparatus of claim 6, the spreading mechanism comprising a pressure-fluid operated drive.

8. In the mobile apparatus of claim 6, the rail engaging and guiding means including a pair of cooperating flanged wheels mounted laterally movably on the chassis, the flanges of the wheels constituting the part engaging the inside of the associated rail, the spreading mechanism being mounted on the chassis and being arranged to move the flanged wheels laterally into play-free engagement with the rails.

9. In the mobile apparatus of claim 6, the rail engaging and guiding means including a pair of cooperating flanged wheels mounted on the chassis, one of the wheels being laterally movable in relation to the chassis and the other wheel being laterally fixed in relation to the chassis, and the spreading mechanism being fixedly mounted on the chassis and being arranged to move the one wheel into play-free engagement with the rail associated therewith whereby the other wheel is pressed into play-free engagement with the other rail.

10. In the mobile apparatus of claim 6, each of the cooperating elements being constituted by a flanged wheel of a respective pair of flanged wheels, the wheels of each pair being interconnected by a rigid axle, the flanges of the cooperating wheels constituting the part engaging the inside of the associated rail, the axles being laterally movable in relation to each other transversely of the track, and the spreading mechanism comprising a drive arranged to act on the connecting means for laterally moving the axles to press one of the cooperating flanged wheels of one pair without play against one of the rails while pressing the other cooperating flanged wheel of the other pair without play against the other rail.

11. In the mobile apparatus of claim 10, connecting means comprising a linkage between the axles.

12. In the mobile apparatus of claim 10, guide means for guiding the lateral movement of at least one of the axles.

13. In the mobile apparatus of claim 1, the load means comprising a hydraulic drive associated with each of the rails.

14. In the mobile apparatus of claim 1, the rail engaging and guiding elements including a part engaging the outside of the track rails, and the means for laterally pressing the elements without play against both rails simultaneously comprises a mechanism for locking the elements in a position wherein the part presses against the outside of the track rails.

15. In the mobile apparatus of claim 14, the rail engaging and guiding element including cooperating pairs of said elements associated with each of the rails, the elements each having a part respectively engaging the inside and the outside of the associated rail, and the means for laterally pressing the elements without play against both rails simultaneously comprises a hydraulic drive means for moving the elements of the cooperating pairs to press their parts respectively against the inside and the outside of the associated rail without play.

16. In the mobile apparatus of claim 15, one element of the cooperating pairs being a flanged wheel having a vertically extending flange constituting the part engaging the inside of the associated rail and the other element of the cooperating pairs being a flanged wheel having a substantially horizontally extending flange subtending the rail head and constituting the part engaging the outside of the associated rail.

17. In the mobile apparatus of claim 1, the means for laterally pressing the rail engaging and guiding means comprising hydraulic drive means, the power of the vibration producing means being about double that of the hydraulic drive means.

18. In the mobile apparatus of claim 17, means for constantly supplying hydraulic fluid to the drive means for effectuating constant pressing of the rail engaging and guiding means without play against the associated rail.

19. In the mobile apparatus of claim 1, a car mounted on two undercarriages for mobility on the track, the chassis being arranged between the two undercarriages, the load means comprising a hydraulic drive associated with each of the rails and the hydraulic drives connecting the chassis to the car, and a reference system extending between the undercarriages of the car for controlling the pressing of the track to a lower level.

20. In the mobile apparatus of claim 1, a track tamping and position correcting machine arranged to precede the apparatus in the operating direction.

21. In the mobile apparatus of claim 1, hydraulic means for laterally moving the track associated with the chassis.

22. In the mobile apparatus of claim 21, the hydraulic means for laterally moving the track being pivotally linked to the chassis.

* * * * *